US006271803B1

(12) United States Patent
Watanabe et al.

(10) Patent No.: US 6,271,803 B1
(45) Date of Patent: Aug. 7, 2001

(54) CHIP ANTENNA AND RADIO EQUIPMENT INCLUDING THE SAME

(75) Inventors: Kunihiro Watanabe, Shiga-ken; Teruhisa Tsuru, Kameoka; Seiji Kanba, Kusatsu; Tsuyoshi Suesada, Shiga-ken; Yujiro Dakeya, Omihachiman, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/345,197

(22) Filed: Jun. 30, 1999

(30) Foreign Application Priority Data

Jul. 3, 1998 (JP) ..... 10-188809

(51) Int. Cl.[7] ..... H01Q 1/24; H01Q 1/36

(52) U.S. Cl. ..... 343/895; 343/702; 343/873

(58) Field of Search ..... 343/702, 895, 343/873, 700 MS; H01Q 1/24, 1/38, 1/36

(56) References Cited

U.S. PATENT DOCUMENTS

| | | | | |
|---|---|---|---|---|
| 5,541,616 | * | 7/1996 | Kawahata et al. | 343/702 |
| 5,668,557 | * | 9/1997 | Kawahata | 343/702 |
| 5,870,066 | * | 2/1999 | Asakura et al. | 343/702 |
| 5,903,240 | * | 5/1999 | Kawahata et al. | 343/702 |
| 6,002,366 | * | 12/1999 | Kawahata et al. | 343/702 |
| 6,023,251 | * | 2/2000 | Koo et al. | 343/702 |

* cited by examiner

*Primary Examiner*—Hoanganh Le
(74) *Attorney, Agent, or Firm*—Ostrolenk, Faber, Gerb & Soffen, LLP

(57) ABSTRACT

A chip antenna comprising a basic body made of a ceramic material; a first conductor and a second conductor respectively disposed at least either inside or on the surface of the basic body so as to be close to each other; a feeding terminal for applying a voltage to the first conductor disposed on the surface of the basic body and connected to the first conductor; and a grounding terminal disposed on the surface of the basic body and connected to the second conductor.

26 Claims, 8 Drawing Sheets

CHIP ANTENNA AND RADIO EQUIPMENT INCLUDING THE SAME

BACKGROUND OF THE INVENTION

1. Field of the Invention

The present invention relates to a chip antenna and to radio equipment including such a chip antenna. More particularly, this invention relates to a small-sized and broad-bandwidth chip antenna and the radio equipment including such a chip antenna.

2. Description of the Related Art

Up to now, in radio equipment such as a portable telephone terminal, a pager, etc., there have been used a wire antenna represented by a monopole antenna. When the radio equipment is made small-sized, the antenna is required to be of small size. However, in the case of a monopole antenna, as the length of a radiation conductor becomes $\lambda/4$ ($\lambda$: wavelength of the resonance frequency), for example, about 4 cm in the case of an antenna having 1.9 GHz as its resonance frequency, the antenna itself comes to be too large, which means a problem because the need for small size cannot be satisfied.

To overcome the above problem, the present applicant has proposed a chip antenna as shown in FIG. 12 herein and in Japanese Unexamined Patent Publication No. 8-316725. The chip antenna 50 comprises a basic body 51 of a rectangular solid made up of dielectric ceramics containing barium oxide, aluminum oxide, and silica as its main components, a conductor 52 spirally arranged inside the basic body 51, and a feeding terminal 53 for applying a voltage to the conductor 52 formed on the surface of the basic body 51. One end of the conductor 52 is led out to the surface of the basic body 51 and connected to a feeding terminal 53. Further, the other end of the conductor 52 is made a free end 54 inside the basic body 51.

In the above construction, a small-sized chip antenna 50 has been realized by means of the spirally disposed conductor 52.

Generally, the resonance frequency f and bandwidth BW of a chip antenna are expressed as in the following equations:

$$f=1/(2\pi\cdot(L\cdot C)^{1/2}) \quad (1)$$

$$BW=k\cdot(C/L)^{1/2} \quad (2)$$

where L is the inductance of the conductor, C is the capacitance produced between the conductor and ground, and k is a constant.

FIG. 13 shows the frequency characteristic of the reflection loss of the chip antenna 50 of FIG. 12. From this drawing, it is understood that the bandwidth of a chip antenna 50 giving two or more of VSWR (voltage standing wave ratio) is about 225 MHz around the center frequency of 1.95 GHz.

However, in the case of the above-mentioned chip antenna, as the conductor is spirally arranged in order to make the chip antenna small-sized, the inductance L of the conductor becomes large. As a result, as clearly understood from Equation (2) there is a problem that as the inductance L of the conductor increases the bandwidth BW is narrowed.

SUMMARY OF THE INVENTION

To overcome the above described problems, the present invention provides a chip antenna of small size and having a large bandwidth and radio equipment including such a chip antenna.

One preferred embodiment of the present invention provides a chip antenna comprising a basic body made of a ceramic material; a first conductor and a second conductor respectively disposed at least either inside or on the surface of the basic body so as to be close to each other; a feeding terminal for applying a voltage to the first conductor, disposed on the surface of the basic body, and connected to the first conductor; and a grounding terminal disposed on the surface of the basic body and connected to the second conductor.

According to the above structure and arrangement, because at least inside or on the surface of the basic body one end of the first conductor is connected to the feeding terminal and one end of the second conductor is connected to the grounding terminal and disposed so as to be close to each other, leakage current generated from the first conductor flows through the second conductor.

Consequently, as the first and second conductors resonate at the same time because of the leakage current, only the feed to the first conductor causes the chip antenna to have a plurality of resonance frequencies, which makes it possible for the chip antenna to be small-sized, of broad bandwidth, and of low power dissipation.

In the above described chip antenna, at least one of the first and second conductors may be connected to a free terminal, and the free terminal may be disposed on the surface of the basic body.

According to the above described structure and arrangement, because the free terminal to which the other end of at least one of the first and second conductors is connected is disposed on the surface of the basic body, the capacitance generated between the first and second conductors of the chip antenna and the ground of the radio equipment mounted with the chip antenna is able to be increased. Therefore, it becomes possible to lower resonance frequencies and broaden bandwidth.

In the above described chip antenna, the first and second conductors may be disposed so as to be parallel to each other.

According to the above described structure and arrangement, the first and second conductors may be enlarged and accordingly the line length of the first and second conductors is lengthened.

Therefore, because the inductance values of the first and second conductors may be made large, it becomes possible to lower the resonance frequencies and widen the bandwidth.

In the above described chip antenna, the first and second conductors may be disposed substantially spirally.

According to the above described structure and arrangement, because first and second conductors are spirally formed by adjustment of the pitch of the coil of the first conductor and the pitch of the coil of the second conductor, it is possible to easily adjust the inductance values of the first and second conductors. Therefore, it becomes possible to easily adjust the resonance frequencies and bandwidth.

In the above described chip antenna, the first and second conductors may be formed substantially in a meandering way.

According to the above described structure and arrangement, it is possible to lower the height of the basic body and accordingly it becomes possible to lower the height of the chip antenna.

Another preferred embodiment of the present invention provides radio equipment including any one of the above described chip antennas.

Because a small-sized and broad-bandwidth chip antenna is provided, radio equipment of small size and of broad bandwidth can be realized.

Other features and advantages of the present invention will become apparent from the following description of the invention which refers to the accompanying drawings.

BRIEF DESCRIPTION OF THE DRAWING(S)

DETAILED DESCRIPTION OF EMBODIMENTS OF THE INVENTION

Figure 1:
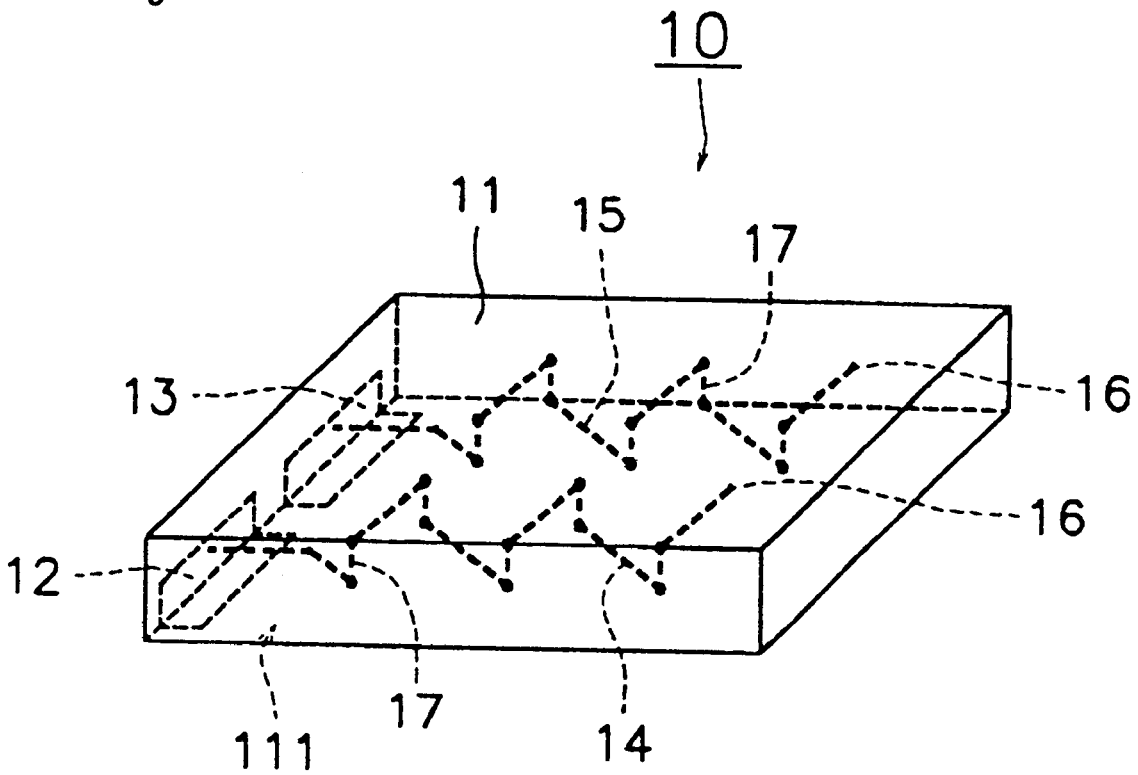
FIG. 1 is a perspective view of a first preferred embodiment relating to a chip antenna of the present invention.
Figure 2:
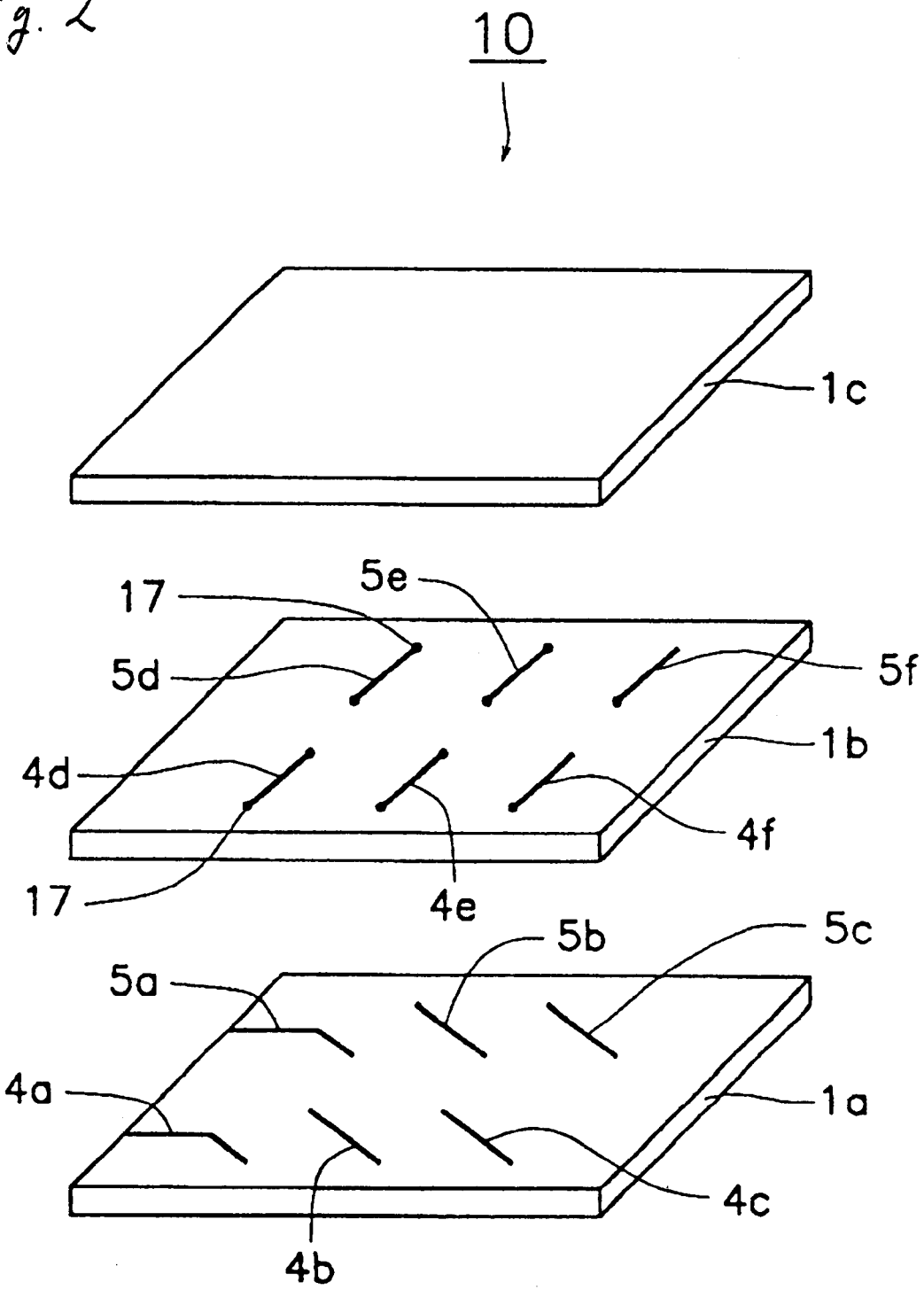
FIG. 2 is an exploded perspective view of the chip antenna shown in FIG. 1.

FIGS. 1 and 2 are a perspective view and an exploded perspective view of a first preferred embodiment of a chip antenna according to the present invention, respectively. The chip antenna 10 includes a basic body 11 of a rectangular solid having a component side 111 and on the surface of the basic body 11 a feeding terminal 12 and a grounding terminal 13 are disposed.

Further, inside the basic body 11, a first conductor 14 illustratively having an effective length of 17.6 mm and a second conductor 15 illustratively having an effective length of 31.7 mm, both of which are spirally disposed so that the coil axis is parallel to the component side 111, that is, in the direction of the long side of the basic body 11, are formed so as to be close to each other.

One end of the first conductor 14 is connected to the feeding terminal 14, and the other end is made to form a free terminal inside the basic body 11.

Further, one end of the second conductor is connected to a grounding terminal 13, and the other end is made to form a free terminal inside the basic body 11.

The basic body 11 comprises laminated rectangular thin layers 1*a* through 1*c* made up of dielectric ceramics, the main components of which are barium oxide aluminum oxide, and silica.

On the surface of thin layers 1*a* and 1*b*, conductor patterns of copper or copper alloy 4*a* through 4*f* and 5*a* through 5*f* nearly in the shape of letter L or nearly in a linear shape are provided by printing, evaporation, pasting or plating.

Further, at a fixed position of a thin layer 1*b* (both ends of conductor patterns 4*d*, 4*e*, 5*d*, and 5*e* and one end of conductor patterns 4*f* and 5*f*), conductive via holes 17 are provided in the thickness direction.

By sintering after thin layers 1*a* through 1*c* have been laminated and conductor patterns 4*a* through 4*f* and 5*a* through 5*f* connected through via holes 17, the first conductor 14 and second conductor 15 which are spirally disposed in the direction of the long side of the basic body 11 are formed inside the basic body 11.

One end of the first conductor 14 (one end of the conductor pattern 4*a*) is led out to the surface of the basic body 11 and connected to the feeding terminal 12 provided on the surface of the basic body 11 in order to apply a voltage to the first conductor 14. Further, the other end of the first conductor 14 (the other end of the conductor pattern 4*f*) is made to be a free terminal 16 inside the basic body 11.

Further, one end of the second conductor 15 (one end of the conductor pattern 5*a*) is led out on the surface of the basic body 11 and connected to the grounding terminal 13 provided on the surface of the basic body 11 in order to be connected to the ground (not illustrated) on a mounting substrate for the chip antenna 10 to be mounted. Further, the other end of the second conductor 15 (the other end of the conductor pattern 5*f*) is made to be a free terminal.

Figure 3:
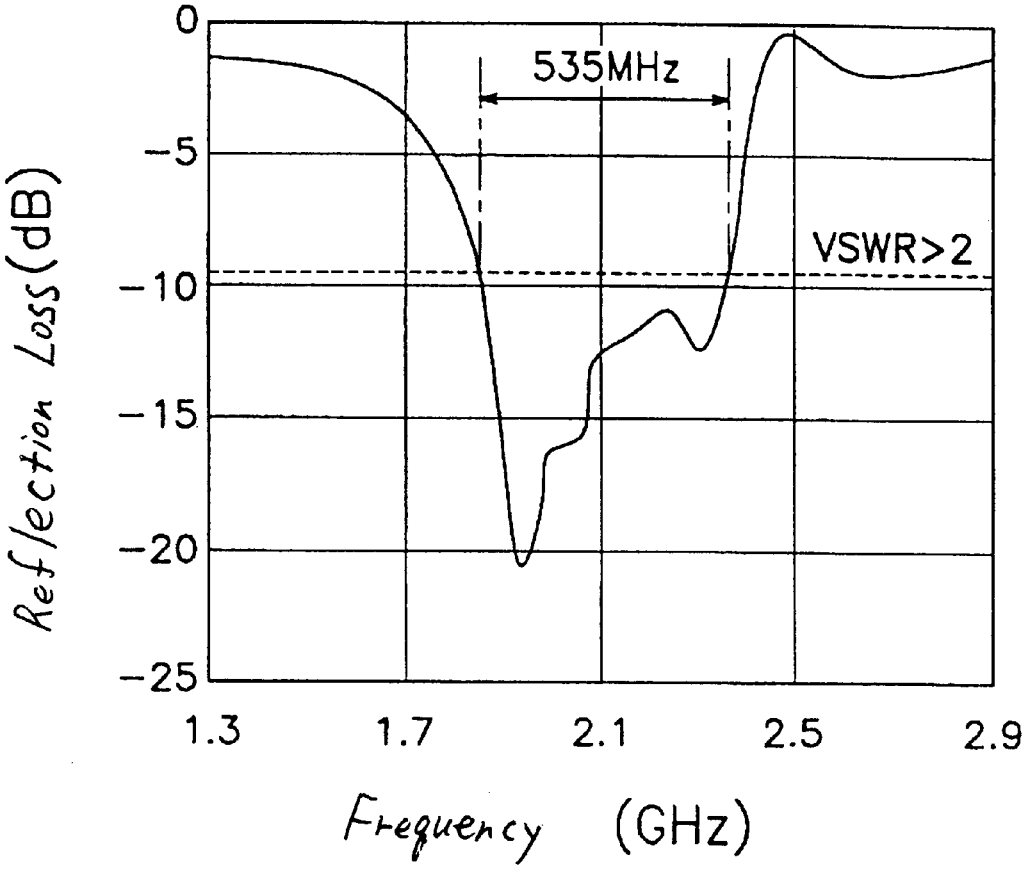
FIG. 3 shows the frequency characteristic of the reflection loss of the chip antenna shown in FIG. 1.
Figure 13:
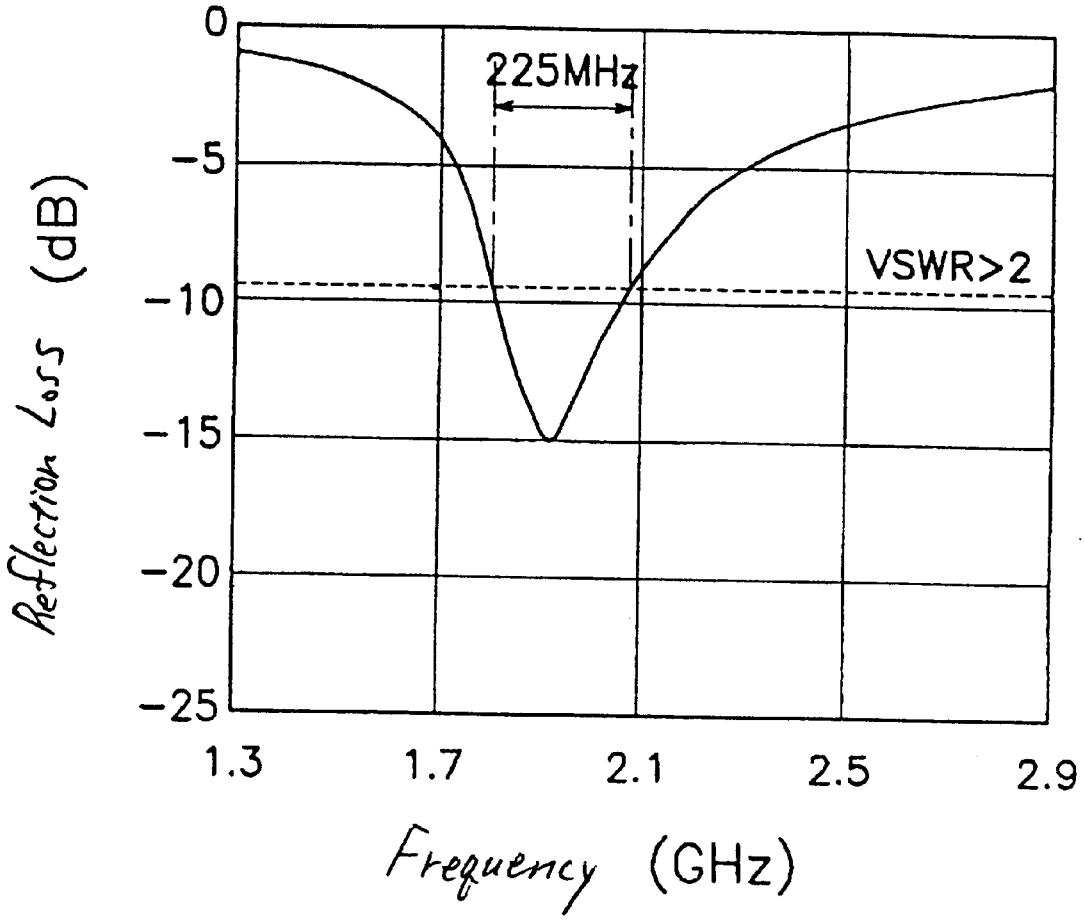
Fig. 13 Prior Art
FIG. 13 shows the frequency characteristic of the reflection loss of the chip antenna shown in FIG. 12.

FIG. 3 shows the frequency characteristic of the reflection loss of the chip antenna 10 (FIG. 1). From this drawing, it is understood that the bandwidth of a chip antenna 10 providing two or more of VSWR is about 535 MHz around the center frequency of 2.10 GHz. That is, it is understood that the bandwidth which is about 2.4 times as broad as about 225 MHz (FIG. 13) of a conventional chip antenna 50 is attained.

Figure 4:
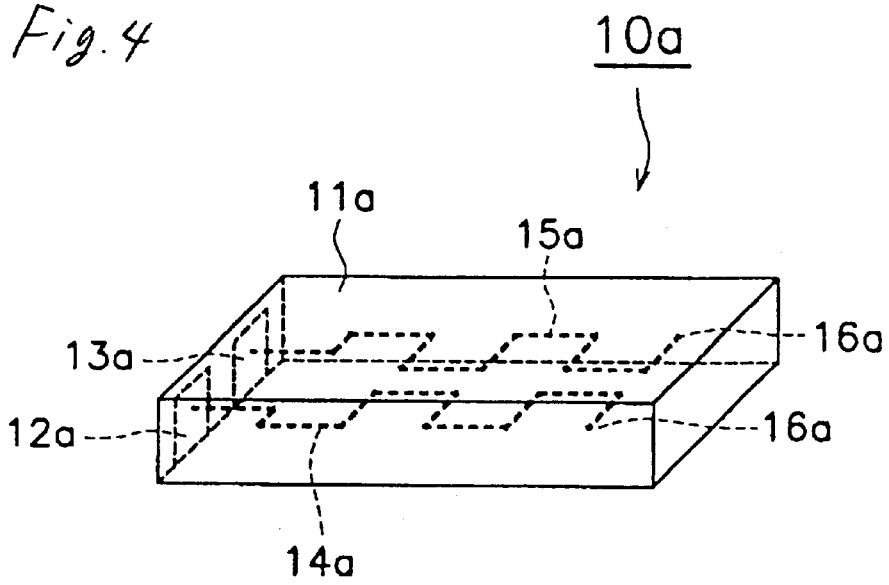
FIG. 4 is a perspective view of a modification of the chip antenna shown in FIG. 1.

FIG. 4 is a perspective view of a modification of the chip antenna 10 in FIG. 1. The chip antenna 10*a* comprises a basic body 11*a* of a rectangular solid, a feeding terminal 12*a* and a grounding terminal 13*a* provided on the surface of the basic body 11*a*, and first and second conductors 14*a*, 15*a* meanderingly formed inside the basic body 11*a*.

One end of the first conductor 14*a* is led out to the surface of the basic body 11*a* and connected to the feeding terminal 12*a*, and the other end is made to be a free terminal 16*a* inside the basic body 11*a*. Further, one end of the second conductor 15*a* is led to the surface of the basic body 11*a* and connected to the grounding terminal 13*a*, and the other end is made to be a free terminal 16*a* inside the basic body 11*a*.

According to the above described chip antenna of the first embodiment, as the first conductor, one end of which is connected to the feeding terminal and the second conductor, one end of which is connected to the grounding terminal, are formed so as to be close to each other, leakage current is generated from the first conductor and the leakage current flows through the second conductor.

Therefore, as the first conductor and second conductor resonate at the same time because of the leakage current, only the feed to the first conductor causes the chip antenna to have a plurality of resonance frequencies, which makes it possible for the chip antenna to be small-sized, of broad bandwidth and of low power dissipation.

Further, in the embodiment of FIG. 1, because the first and second conductors are spirally disposed, the inductance values of the first and second conductors are able to be easily adjusted by adjustment of the pitch of the coil of the first conductor and the pitch of the coil of the second conductor. Accordingly, as clearly understood from Equations (1) and (2), it is possible to adjust the resonance frequency f and bandwidth BW easily.

Moreover, in the modified example of FIG. 4, became the first and second conductors are meanderingly formed, it is possible to lower the height of the basic body, and accordingly, the height of a chip antenna can be lowered, also.

Figure 5:
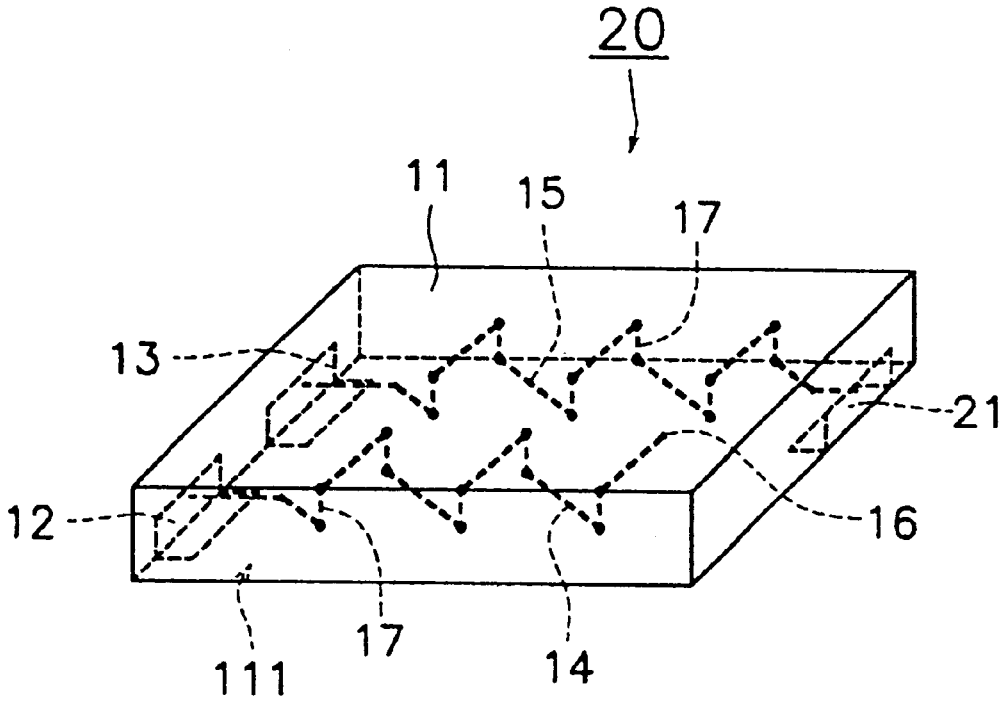
FIG. 5 is a perspective view of a second preferred embodiment relating to a chip antenna of the present invention.

FIG. 5 is an exploded perspective view of a second preferred embodiment of a chip antenna according to the present invention. The chip antenna 20 comprises a basic body 11 of a rectangular solid having a component side 111, and on the surface of the basic body a feeding terminal 12, a grounding terminal 13 and a free terminal 21 are provided.

Further, inside the basic body 11 first and second conductors 14, 15 spirally arranged in the direction of the long side of the basic body 11 are formed so as to be close to each other.

In this case, one end of the first conductor 14 is led to the surface of the basic body 11 and connected to the feeding terminal 12, and the other end is made to be a free end 16. Further, one end and the other end of the second conductor 15 are led to the surface of the basic body 11 and connected to the grounding terminal 13 and the free terminal respectively.

The chip antenna 20 is different from the chip antenna 10 (FIG. 1) of the first embodiment in that the other end of the second conductor 13 is connected to the free terminal 21 provided on the surface of the basic body 11.

Figure 6:
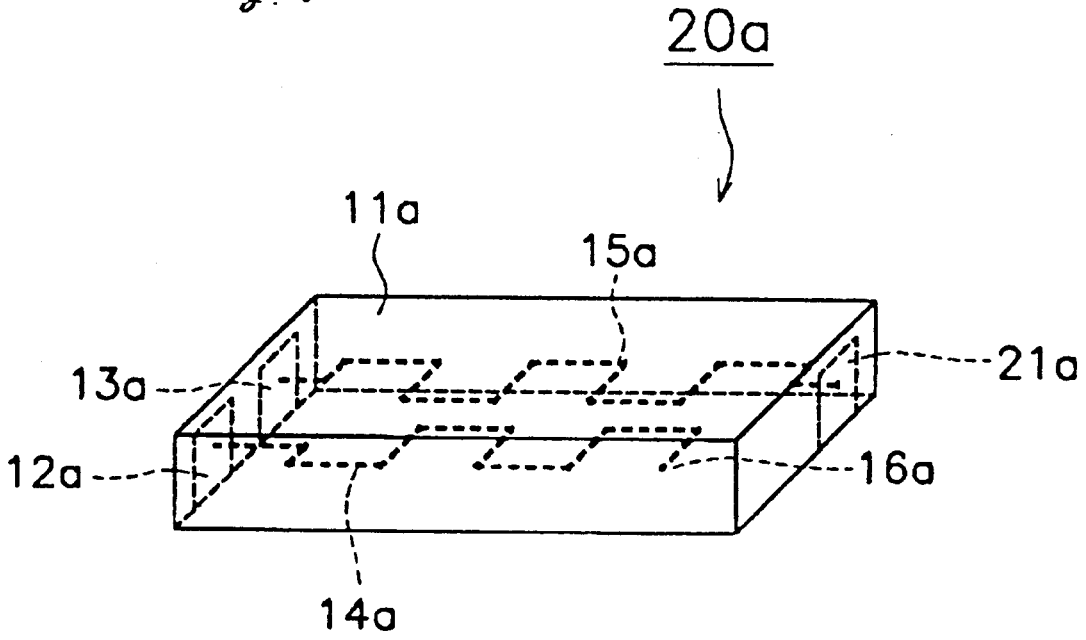
FIG. 6 is a perspective view of a modification of the chip antenna shown in FIG. 5.

FIG. 6 is a perspective view of a modified example of the chip antenna 20 shown in FIG. 5. The chip antenna 20*a* comprises a basic body 11*a* of a rectangular solid, a feeding terminal 12*a*, a grounding terminal 13*a*, and a free terminal 21*a* provided on the surface of the basic body 11*a*, and first and second conductors 14*a*, 15*a* meanderingly formed inside the basic body 11*a*.

One end of the first conductor 14*a* is led to the surface of the basic body 11*a* and connected to the feeding terminal 12*a*, and the other end is made to be a free end 16*a* inside the basic body 11*a*. Further, one end and the other end of the second conductor 15*a* are led to the surface of the basic body 11*a* and connected to the grounding terminal 13*a* and the free terminal 21*a* respectively.

According to the above described chip antenna of a second embodiment, because the free terminal to which the other end of the second conductor is connected is provided on the surface of the basic body, the capacitance generated between the second conductor of the chip antenna and the ground of the radio equipment mounted with the chip antenna is able to be enlarged.

In consequence, as clearly seen from Equations (1) and (2), it becomes possible to lower resonance frequencies f and broaden bandwidth BW.

Figure 7:
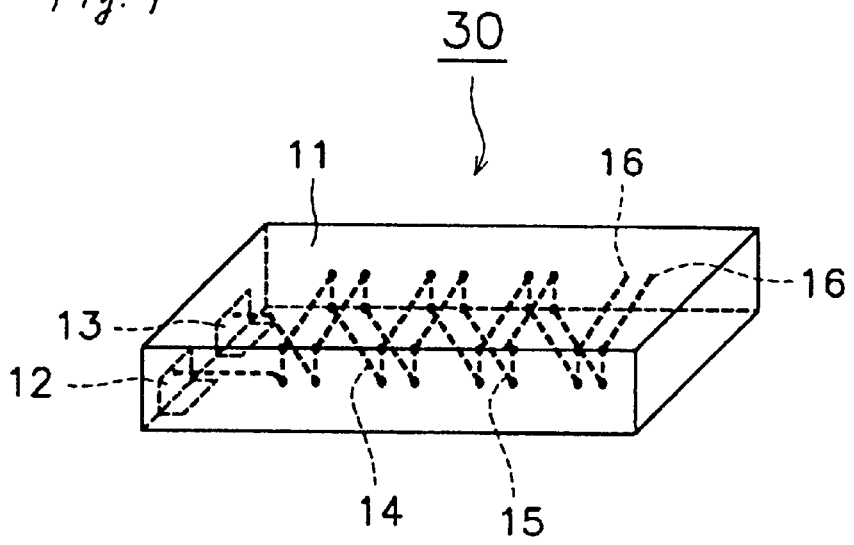
FIG. 7 is a perspective view of a third preferred embodiment relating to a chip antenna of the present invention.

FIG. 7 is an exploded perspective view of a third preferred embodiment of a chip antenna according to the present invention. The chip antenna 30 comprises a basic body 11 of a rectangular solid, a feed terminal 12 and a grounding terminal 13 provided on the surface of the basic body 11, and first and second conductors 14, 15 spirally arranged inside the basic body 11.

The effective length of the first conductor 14 is illustratively 64.9 mm. One end of the first conductor 14 is led to the surface of the basic body 11 and connected to the feed terminal 12, and the other end is made to be a free end 16 inside the basic body 11. Further, the effective length of the second conductor 15 is illustratively 82.6 mm. One end of the second conductor 15 is led to the surface of the basic body 11 and connected to the grounding terminal 13, and the other end is made to be a free end 16 inside the basic body 11.

The chip antenna 30 is different from the chip antenna 10 (FIG. 1) of the first embodiment in that the first conductor 14 and second conductor 15 are formed so as to be parallel to and transmitted with each other.

Figure 8:
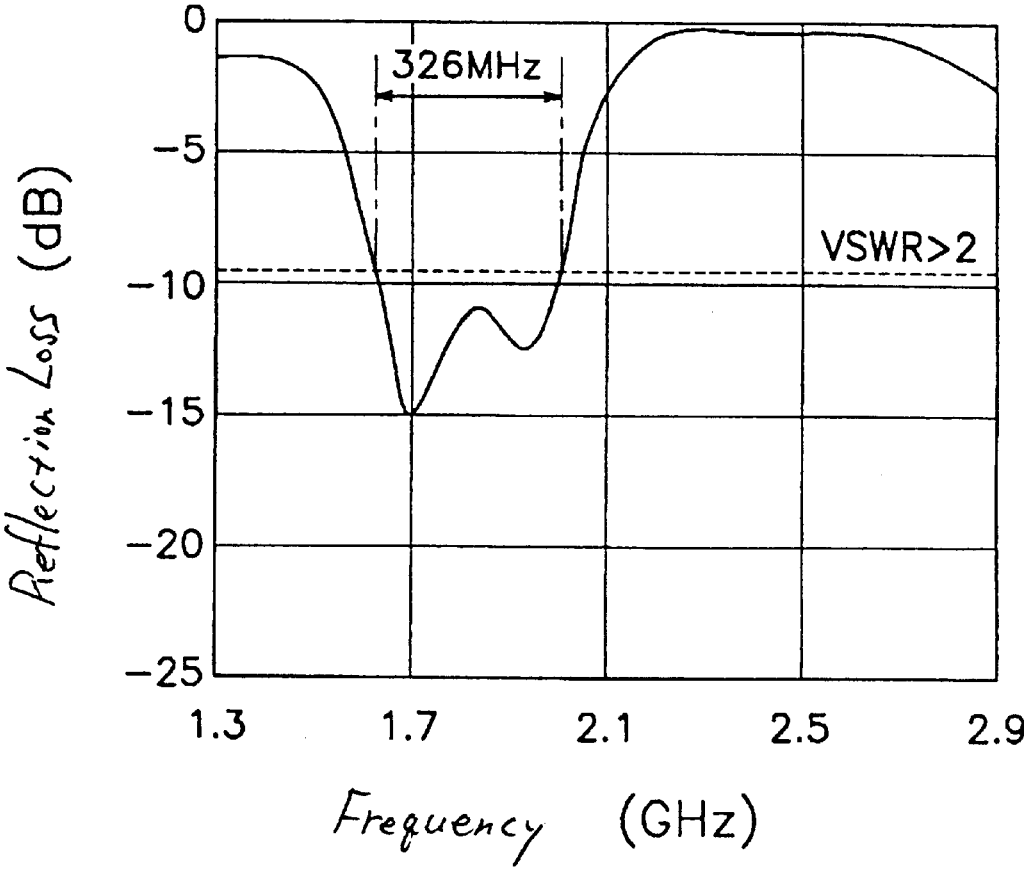
FIG. 8 shows the frequency characteristic of the reflection loss of the chip antenna shown in FIG. 7.

FIG. 8 shows the frequency characteristic of the reflection loss of the chip antenna 30 (FIG. 7). From this drawing, the bandwidth of a chip antenna 30 giving two or more of VSWR is about 326 MHz around the center frequency of 1.79 GHz. That is, a bandwidth about 1.4 times as broad as the bandwidth of about 225 MHz (FIG. 13) of a conventional chip antenna 50 has been attained.

Figure 9:
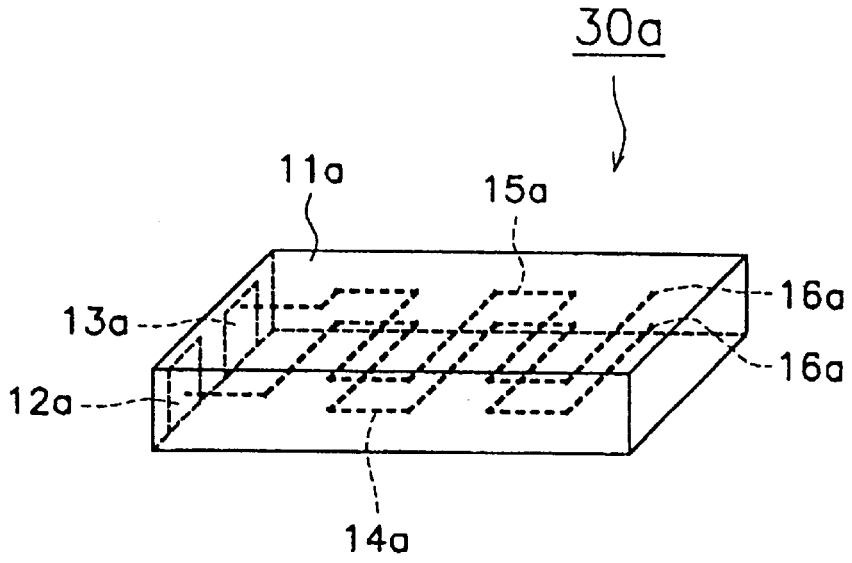
FIG. 9 is a perspective view of a modification of the chip antenna shown in FIG. 7.

FIG. 9 is a perspective view of a modification of the chip antenna 30 shown in FIG. 7. The chip antenna 30*a* comprises a basic body 11*a* of a rectangular solid, a feeding terminal 12*a* and a grounding terminal 13*a* provided on the surface of the basic body 11*a* and first and second conductors 14*a*, 15*a* meanderingly formed inside the basic body 11*a*.

The effective length of the first conductor 14*a* is illustratively 27.4 mm. One end of the first conductor 14 is led to the surface of the basic body 11*a* and connected to the feed terminal 12*a*, and the other end is made to be a free end 16*a* inside the basic body 11*a*. Further, the effective length of the second conductor 15*a* is illustratively 32.9 mm. One end of the second conductor 15*a* is led to the surface of the basic body 11*a* and connected to the grounding terminal 13*a* and the other end is made to be a free end 16*a* inside the basic body 11*a*.

Figure 10:
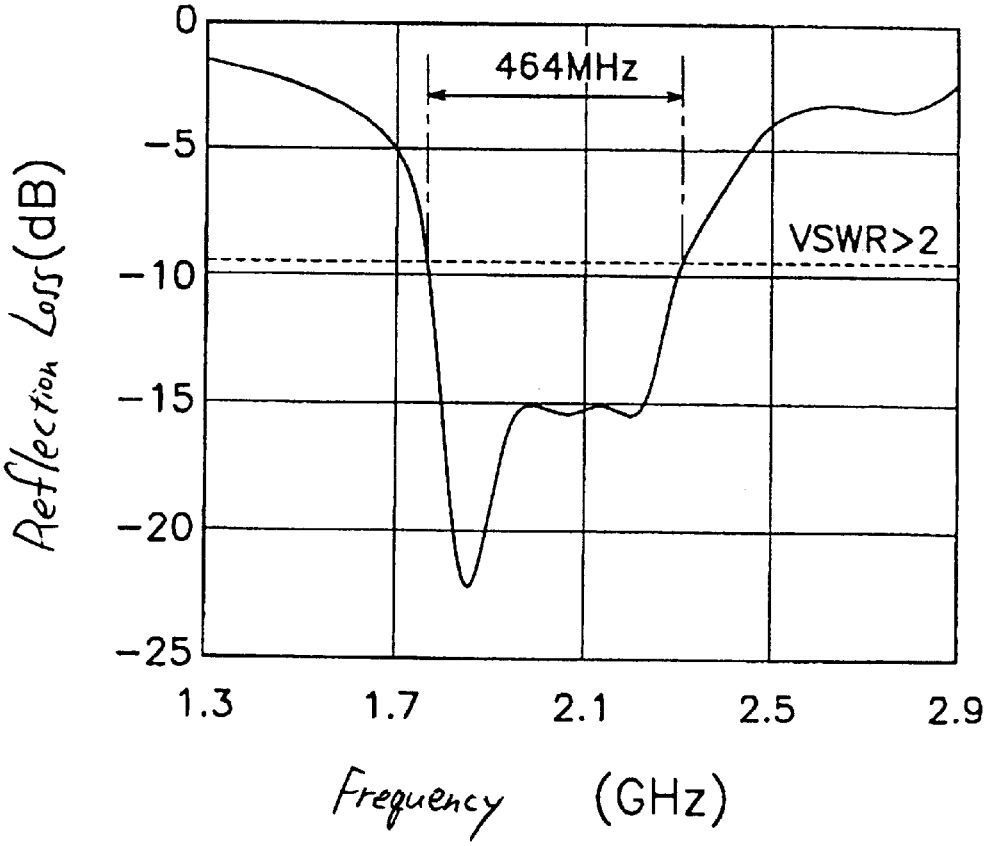
FIG. 10 shows the frequency characteristic of the reflection loss of the chip antenna shown in FIG. 9.

FIG. 10 shows the frequency characteristic of the reflection loss of the chip antenna 30*a* (FIG. 9). From this drawing, the bandwidth of a chip antenna 30*a* giving two or more of VSWR is about 464 MHz around the center frequency of 2.01 GHz. That is, a bandwidth of about 2.1 times the bandwidth of about 225 MHz (FIG. 13) of a conventional chip antenna 50 has been attained.

According to the above-mentioned chip antenna of a third embodiment, because the first and second conductors are formed so as to be parallel to each other, the first and second conductors are able to be formed so as to be enlarged, and accordingly, the line length of the first and second conductors can be increased.

Therefore, because the inductance values of the first and second conductors are able to be increased, as clearly understood from Equations (1) and (2), it is possible to lower resonance frequencies f and broaden bandwidth BW.

Figure 11:
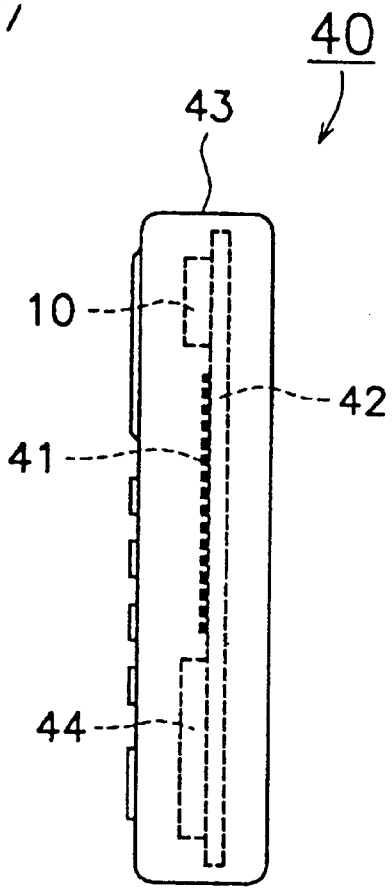
FIG. 11 is a perspective side view of a portable telephone terminal including one of the chip antennas shown in FIG. 1, FIG. 4, FIGS. 5 through 7, and FIG. 9.
Figure 12:
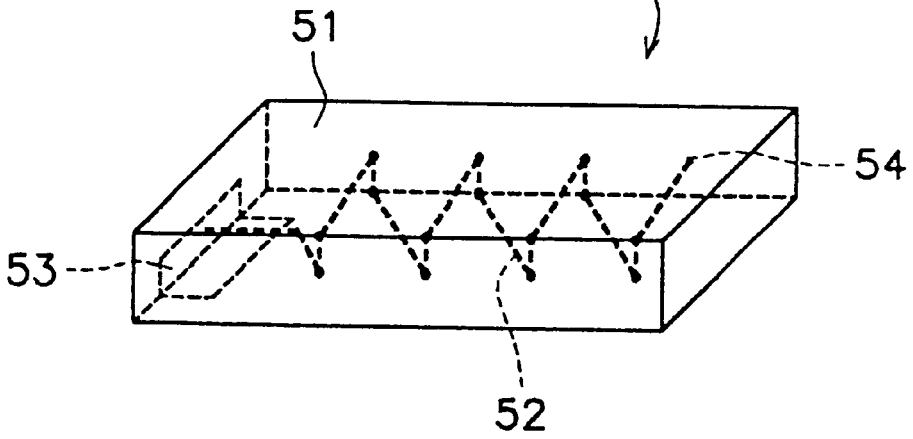
Prior Art Fig. 12
FIG. 12 is a perspective view of a prior art chip antenna.

FIG. 11 shows radio equipment mounted with one of the chip antennas 10, 10*a*, 20, 20*a*, 30, 30*a* shown in FIG. 1, FIG. 4, FIGS. 5 through 7, FIG. 9. The radio equipment, for example, a portable telephone terminal 40, is a circuit board 42 mounted with the chip antenna 10 on one main surface having a ground pattern 41 of the circuit board 42 arranged inside an enclosure 43, and transmits and receives an electronic radio wave through the chip antenna 10. The chip antenna 10 is electrically connected through the RF portion 44 of the portable telephone terminal 40 arranged on one main surface of the circuit board 41 and the transmission line (not illustrated) on the circuit board 41, etc.

According to the above-mentioned portable telephone terminal as the radio equipment, because a small-sized chip antenna having a broad bandwidth is mounted, the radio equipment is able to be made small-sized and of broad bandwidth.

Further, as a chip antenna having an improved gain is mounted, it is possible to improve the gain of the radio equipment.

More, in the above-mentioned first through third embodiments, a basic body made up of dielectric ceramics having barium oxide, aluminum oxide, and silica as its main components was described, but the basic body is not limited to such ceramics. Dielectric ceramics having titanium oxide and neodymium oxide as its main components, magnetic ceramics having nickel oxide, cobalt oxide, and iron oxide as its main components or a combination of dielectric ceramics and magnetic ceramics suffices.

Further, the conductors formed inside the basic body were described, but even if a part of the conductors or all of the conductors are formed on the surface of the basic body, the same effect is able to be brought about.

Furthermore, first and second conductors spirally or meanderingly formed so as to be parallel to the component side of the basic body, that is, in the direction of the long side of the basic body were described, but even if the first and second conductors are spirally or meanderingly formed so as to be perpendicular to the component side of the basic body, that is, in the direction of the height of the basic body, the same effect is able to be brought about.

Further, cases with one first conductor and one second conductor were described, but two or more second conductors may be provided. In this case, as the number of second conductors is increased, the input impedance of a chip antenna can be fine adjusted more precisely. Therefore, it becomes possible to match the characteristic impedance of the high-frequency portion of the radio equipment with the chip antenna more precisely.

Furthermore, in the above second embodiment, the other end of the second conductor connected to the free terminal was described. The other end of the first conductor or the other ends of the first and second conductors may, however be led to the end surface of the basic body and connected to the free terminals given on the surface of the basic body. When both of the other ends of the first and second conductors are connected to the free terminals, they are connected to separate free terminals so that the first and second conductors are not short-circuited.

While the invention has been particularly shown and described with reference to preferred embodiments thereof, it will be understood by those skilled in the art that the forgoing and other changes in form and details may be made therein without departing from the spirit of the invention.

What is claimed is:

1. A chip antenna comprising a basic body comprising a ceramic material comprising a plurality of laminated layers;

a first radiation conductor and a second radiation conductor respectively disposed at least either inside or on a surface of the basic body so as to be adjacent to each other;

a feeding terminal for applying a voltage to the first conductor disposed on the surface of the basic body, and connected to the first conductor; and a grounding terminal disposed on the surface of the basic body and connected to the second conductor.

2. The chip antenna of claim 1, wherein at least one of the first and second conductors is connected to a free, open circuit terminal, and the free, open circuit terminal is disposed on the surface of the basic body.

3. The chip antenna of claim 2, wherein the first and second conductors are disposed so as to be parallel to each other.

4. The chip antenna of claim 2, wherein the first and second conductors are arranged substantially spirally.

5. The chip antenna of claim 2, wherein the first and second conductors are formed substantially in a meandering way.

6. The chip antenna of claim 1, wherein the first and second conductors are disposed so as to be parallel to each other.

7. The chip antenna of claim 6, wherein the first and second conductors are arranged substantially spirally.

8. The chip antenna of claim 7, wherein the parallel disposed first and second conductors are intermeshed.

9. The chip antenna of claim 6, wherein the first and second conductors are formed substantially in a meandering way.

10. The chip antenna of claim 9, wherein the parallel disposed first and second conductors are intermeshed.

11. The chip antenna of claim 6, wherein the parallel disposed first and second conductors are intermeshed.

12. The chip antenna of claim 1, wherein the first and second conductors are arranged substantially spirally.

13. The chip antenna of claim 1, wherein the first and second conductors are formed substantially in a meandering way.

14. The chip antenna of claim 1, wherein the basic body comprises a plurality of laminated layers, at least two of said layers comprising a portion of said first and second conductors, through holes being provided on at least one of said layers so that when the layers are laminated together said first and second conductors are formed.

15. The chip antenna of claim 1, wherein the first and second conductors have a free end.

16. Radio equipment comprising a chip antenna coupled to an RF circuit on a circuit board, the chip antenna comprising a basic body comprising a ceramic material comprising a plurality of laminated layers;

a first radiation conductor and a second radiation conductor respectively disposed at least either inside or on a surface of the basic body so as to be adjacent to each other;

a feeding terminal for applying a voltage to the first conductor disposed on the surface of the basic body, and connected to the first conductor; and a grounding terminal disposed on the surface of the basic body and connected to the second conductor.

17. The radio equipment of claim 16, wherein at least one of the first and second conductors is connected to a free, open circuit terminal, and the free, open circuit terminal is disposed on the surface of the basic body.

18. The radio equipment of claim 17, wherein the first and second conductors are disposed so as to be parallel to each other.

19. The radio equipment of claim 16, wherein the first and second conductors are disposed so as to be parallel to each other.

20. The radio equipment of claim 19, wherein the parallel disposed first and second conductors are intermeshed.

21. The radio equipment of claim 16, wherein the first and second conductors are arranged substantially spirally.

22. The radio equipment of claim 21, wherein the first and second conductors are disposed in parallel to each other and are intermeshed.

23. The radio equipment of claim 16, wherein the first and second conductors are formed substantially in a meandering way.

24. The radio equipment of claim 23, wherein the first and second conductors are disposed in parallel to each other and are intermeshed.

25. The radio equipment of claim 16, wherein the basic body comprises a plurality of laminated layers, at least two of said layers comprising a portion of said first and second conductors, through holes being provided on at least one of said layers so that when the layers are laminated together said first and second conductors are formed.

26. The radio equipment of claim 16, wherein the first and second conductors have a free end.

* * * * *